US005784800A

United States Patent [19]

Santhouse et al.

[11] Patent Number: 5,784,800

[45] Date of Patent: Jul. 28, 1998

[54] CORD REEL DRYER

[75] Inventors: Daniel Santhouse, Wilton, Conn.; Fung Kam Fai, Hong Kong, Hong Kong

[73] Assignee: Conair Corporation, Stamford, Conn.

[21] Appl. No.: 745,684

[22] Filed: Nov. 8, 1996

[51] Int. Cl.[6] ..... A45D 00/00

[52] U.S. Cl. ..... 34/97

[58] Field of Search ..... 34/96, 97; 392/380, 392/383, 384, 385; 242/200, 385, 385.4

[56] References Cited

U.S. PATENT DOCUMENTS

| | | | |
|---|---|---|---|
| 3,949,487 | 4/1976 | Bartram et al. | 34/99 |
| 4,197,448 | 4/1980 | Harigai | 219/370 |
| 4,254,324 | 3/1981 | Vrtaric | 215/361 |
| 4,255,006 | 3/1981 | King | 339/58 |
| 4,417,703 | 11/1983 | Weinhold | 242/107.12 |
| 4,517,757 | 5/1985 | Asada et al. | 38/88 |
| 4,528,440 | 7/1985 | Ishihara | 219/370 |
| 4,658,116 | 4/1987 | Tsang et al. | 219/370 |
| 5,351,417 | 10/1994 | Rubin | 34/90 |
| 5,412,879 | 5/1995 | Wu | 34/97 |

OTHER PUBLICATIONS

Conair® cord-keeper hair dryer Model 080 instruction manual, fall 1996.

HFN Weekly Newspaper, May 1996.

*Primary Examiner*—Henry A. Bennett

*Assistant Examiner*—Steve Gravini

*Attorney, Agent, or Firm*—Ohlandt, Greeley, Ruggiero & Perle

[57] ABSTRACT

A hair dryer includes an air inlet, an air outlet and a primary air passage between the inlet and outlet. The hair dryer employs a housing having side walls and a cord reel positioned in the housing, between the side walls and across the primary air passage between the air inlet and the air outlet. The hair dryer includes at least one vent formed in a side wall of the housing, the vent located between the cord reel and the air outlet and effective to provide a secondary air source for the primary air passage, even when the cord is wound on the cord reel.

6 Claims, 4 Drawing Sheets

CORD REEL DRYER

FIELD OF THE INVENTION

The present invention relates generally to an electric appliance having a cord reel for storing the appliance's power cord within its housing. More particularly, the present invention relates to a hair dryer having a cord reel, and alternative air flow paths in case the hair dryer is operated with the power cord reeled on the cord reel.

BACKGROUND OF THE INVENTION

It is a convenient feature of many electronic, consumer appliances to have a storage area within their housings for storage of the appliance's power cord. By storing the power cord in the appliance's housing, the power cord is protected and is conveniently tucked-away when the appliance is not in use. For example, U.S. Pat. No. 4,517,757 to S. Asada, et al., which issued on May 21, 1985, describes an electric iron that includes a cord or take-up reel for holding the iron's power cord. Accordingly, the power cord is easily accessible to the user whenever the iron is to be used.

In a hair dryer, the position of the cord reel is critical since air flow through the hair dryer must not be obstructed. A typical hair dryer has an air inlet at the rear of the hair dryer, an air outlet at the front of the hair dryer's nozzle and a clear air passage therebetween, except for heating elements and a fan. The air passage must remain clear during operation in order to maintain proper operation of the hair dryer and to prevent excessive heat buildup that may damage the hair dryer. Thus, when the power cord is stored in the hair dryer's housing, the power cord must not block the air passage.

Hair dryers having an internal compartment for storing a power cord, without obstructing air passage therethrough, are known. For example, U.S. Pat. No. 4,528,440 to N. Ishihara, which issued on Jul. 9, 1985, provides a handheld dryer having an internal cord reel that is hand operated and side inlet vents for air passage. To prevent the cord reel from obstructing the air passage, the cord reel is positioned sideways, i.e. to one side of the hair dryer. Thus, the axis of rotation of the cord reel is across the direction of air flow through the dryer and inlet vents are located in the housing side that is opposite the cord reel.

The hair dryer described in U.S. Pat. No. 4,528,440 suffers from limitations due to its design. In particular, the air flow enters the hair dryer from one side and perpendicularly turns to exit the front nozzle of the hair dryer. Thus, air does not efficiently flow through the hair dryer. Also, the weight of the hair dryer's components is not evenly distributed, since the cord reel is be positioned to one side of the hair dryer, making the appliance harder to handle. Further, since the air flow passage is adjacent to the cord reel, the fan which is positioned in the air flow passage is provided along side the cord reel. Therefore, there is limited room to provide a means for automatically winding the power cord around the cord reel. In fact, in the above patent, the power cord is wound about the cord reel by hand.

SUMMARY OF THE INVENTION

Against the foregoing background, it is a primary object of the present invention to provide a hair dryer having a cord reel positioned therein that provides for air passage through the hair dryer regardless of whether the cord is reeled or unreeled.

It is another object of the present invention to provide a hair dryer that provides for auxiliary air passage, when the main path for air passage through the hair dryer is impeded by a reeled cord.

It is a further object of the present invention to provide a hair dryer in which the cord reel has an axis that is positioned parallel to the airflow path, thereby providing the hair dryer a balanced weight distribution.

To accomplish the foregoing objects and advantages, the present invention is a hair dryer having an air inlet, an air outlet and a primary air passage between the inlet and outlet. The hair dryer, in brief, employs a housing having side walls and a cord reel positioned in the housing, between the side walls and across the primary air passage between the air inlet and the air outlet. The hair dryer includes at least one vent formed in a side wall of the housing, the vent located between the cord reel and the air outlet and effective to provide a secondary air source for the primary air passage, even when the cord is wound on the cord reel.

BRIEF DESCRIPTION OF THE DRAWINGS

The foregoing and still further objects and advantages of the present invention will be more apparent from the following detailed explanation of the preferred embodiments of the invention in connection with the accompanying drawings.

DETAILED DESCRIPTION OF THE PREFERRED EMBODIMENT

Figure 1:
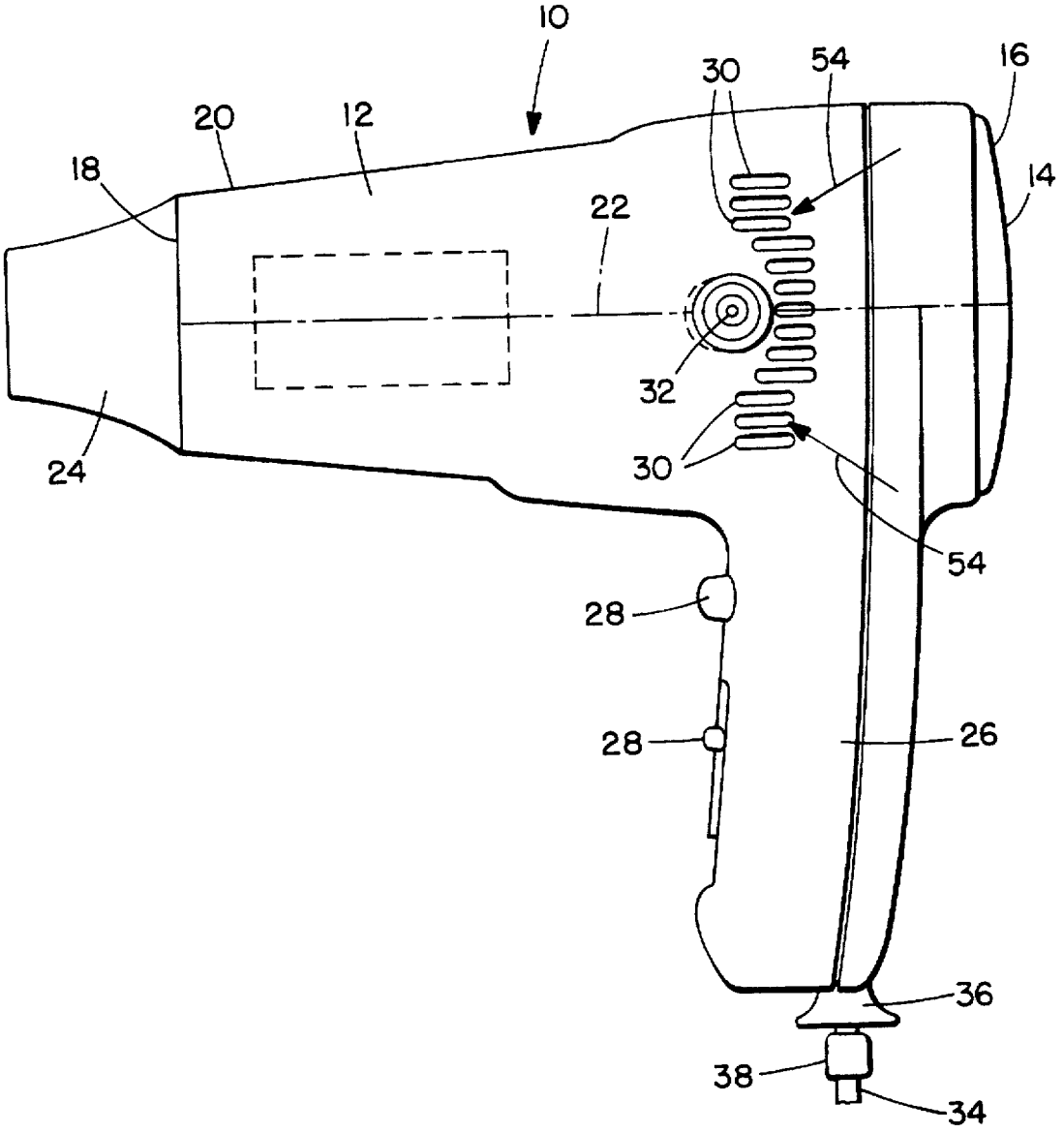
FIG. 1 is a side elevational view of the preferred hair dryer in accordance with the present invention.

Referring to FIG. 1, a hair dryer 10 includes a housing 12, a primary air inlet 14 at a rear portion 16 of the housing, an air outlet 18 at a front portion 20 of the housing and a primary air passage 22 therebetween. The preferred embodiment shown in FIG. 1 also includes a hair dryer attachment 24 positioned in front of air outlet 18.. Accordingly, the passage of air through housing 12 of hair dryer 10 follows a substantially linear path.

As shown in FIG. 1, hair blower includes a handgrip 26 with control buttons and switches 28, a plurality of elongated side vents 30, and a retract button 32, formed on a side of housing 12. Although not shown, mirror image elongated side vents 30 are formed on the side opposite the side shown in FIG. 1.

Before operating hair dryer 10, the user may extend power cord 34 out of a bell-shaped cord opening 36 which provides for low friction, high flexibility passage of power cord 34 through cord opening 36. When the user is ready to store power cord 34 back into housing 12, the user may activate retract button 32 so that power cord 34 is automatically retracted back into housing 12. In addition, a cord stopper 38 is provided near the end of power cord 34 to prevent the end from entering housing 12.

Figure 2:
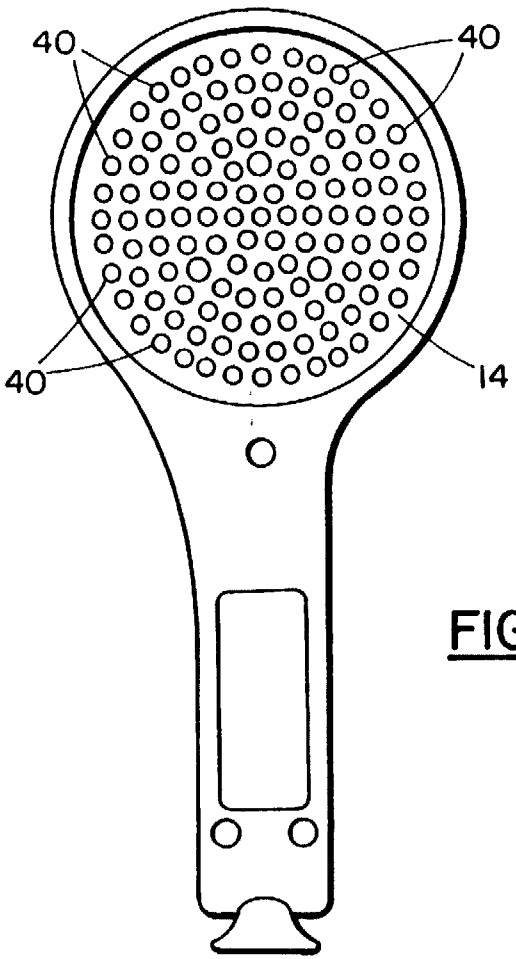
FIG. 2 is a rear view of the hair dryer of FIG. 1.
Figure 3:
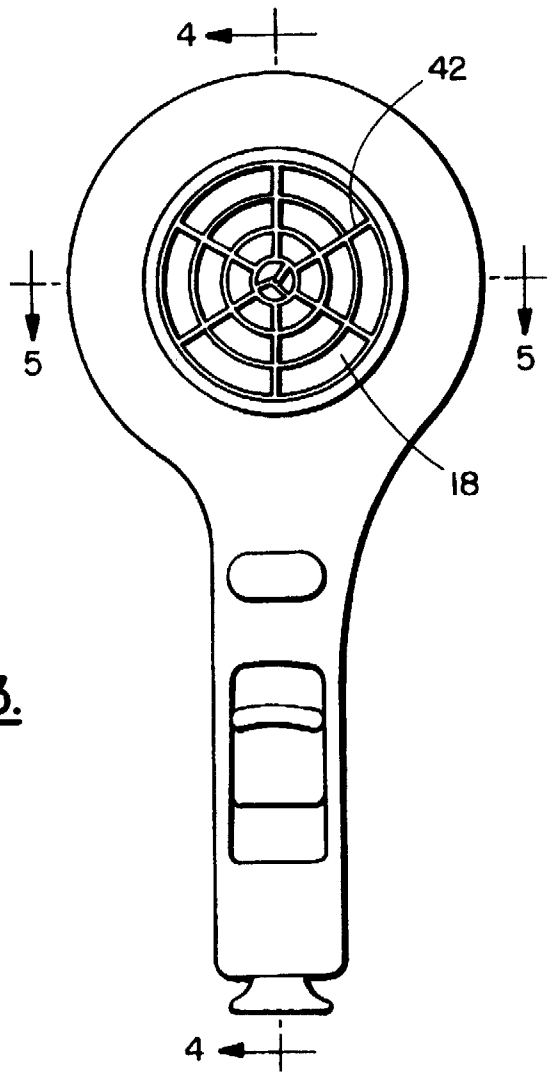
FIG. 3 is a front view of the hair dryer of FIG. 1.

Referring to FIGS. 2 and 3, air inlet 14 at rear portion 16 of housing 12 includes a plurality of air flow holes 40. In FIG. 3, air outlet 18 at front portion 20 of housing 12 is a single large hole, with a grill 42 positioned thereat, either as part of attachment 24 or integral with the main body. As will hereafter be understood, air flow obstruction within housing 12 from air inlet 14 to air outlet 18 is minimal in the preferred embodiment, even when the cord is wound onto the internal cord reel.

Figure 4:
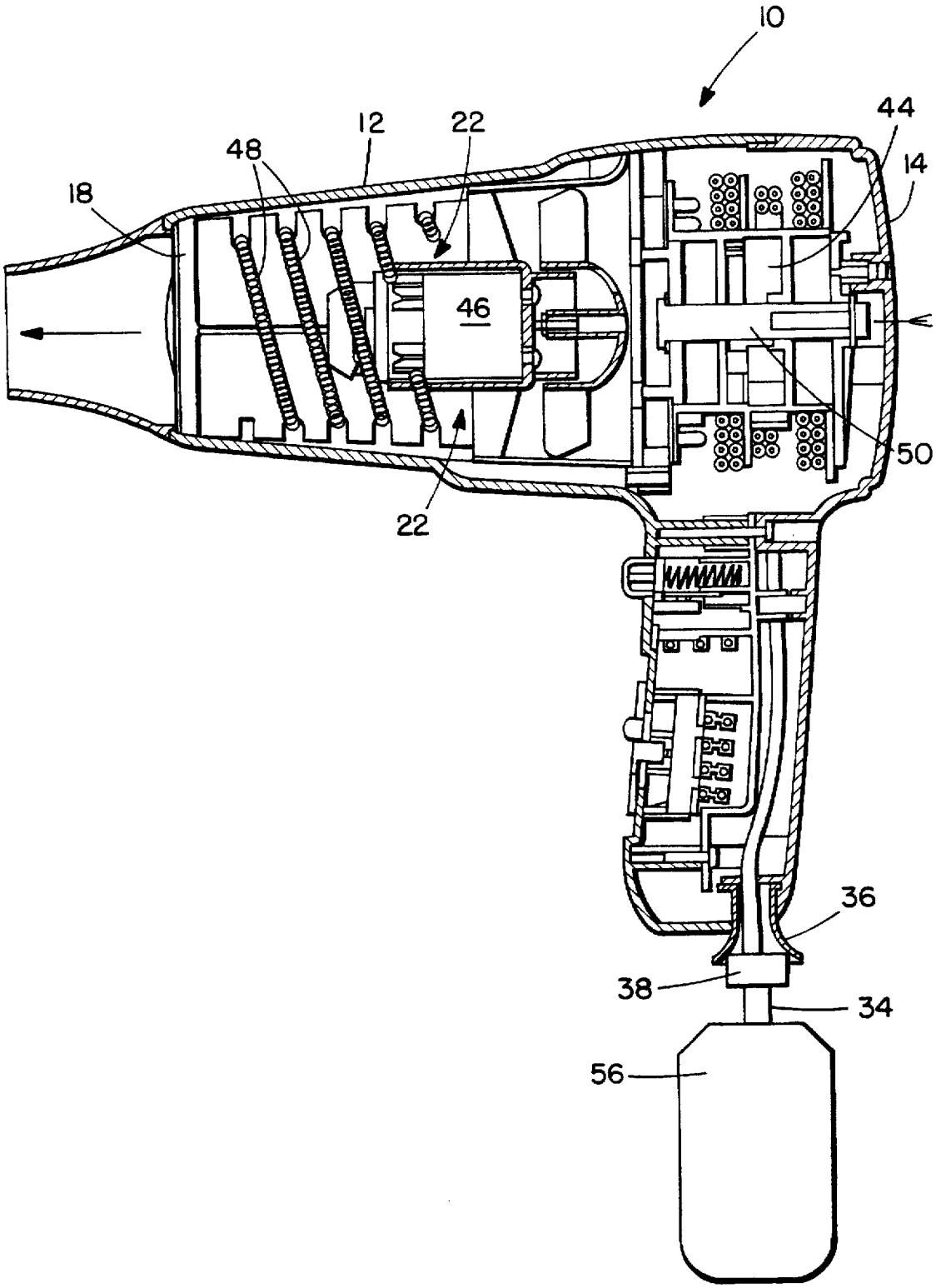
FIG. 4 is a sectional view of the hair dryer taken along line 4—4 of FIG. 3.
Figure 5:
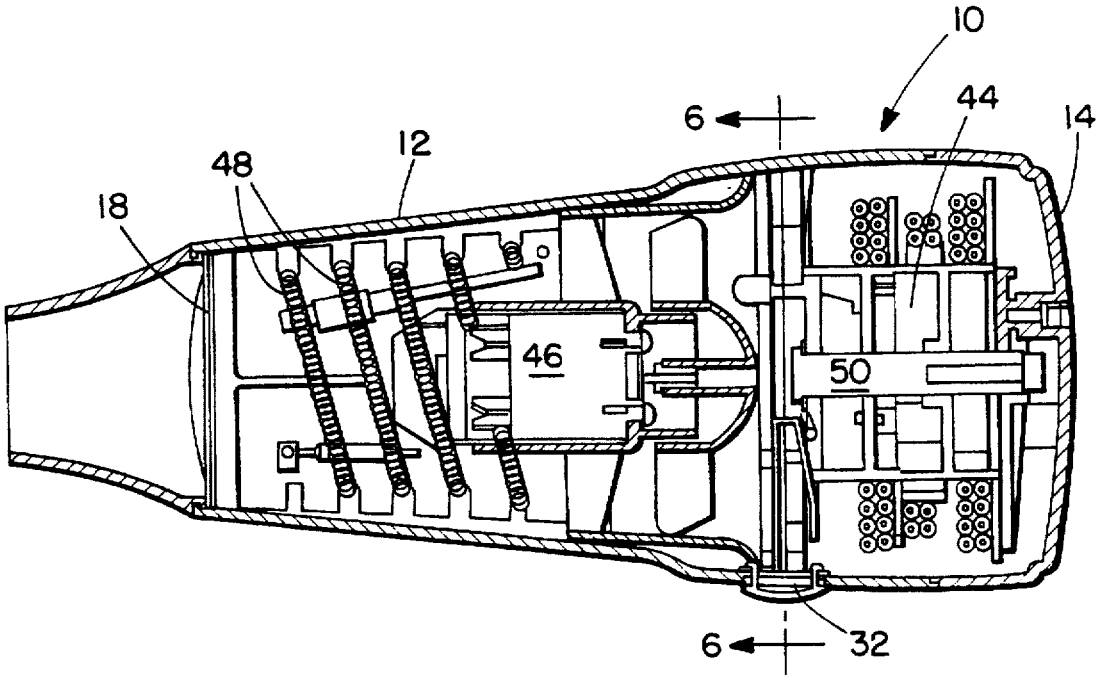
FIG. 5 is a top sectional view of the hair dryer taken along line 5—5 of FIG. 3.

Referring to FIGS. 4 and 5, internal components of hair dryer 10 are shown that are contained in housing 12. In particular, hair dryer 10 includes a take-up cord reel 44, a fan mechanism 46 and heating elements 48 positioned along primary air passage 22. Cord reel 44 rotates about a central axis 50 that is substantially parallel to the air flow direction of primary air passage 22. Thus, central axis of rotation 50 for cord reel 44 is aligned with the air flow direction in primary air passage 22. Similarly, fan mechanism 46 also rotates about an axis that is substantially parallel to the air flow of primary air passage 22. Also, heating elements 48 are positioned in primary air passage 22 to raise the temperature of air passing from air inlet 14 to air outlet 18. As a result, the weight of the various components within housing 12 is evenly distributed about central axis 50, and the unit is well balanced for use.

Figure 6:
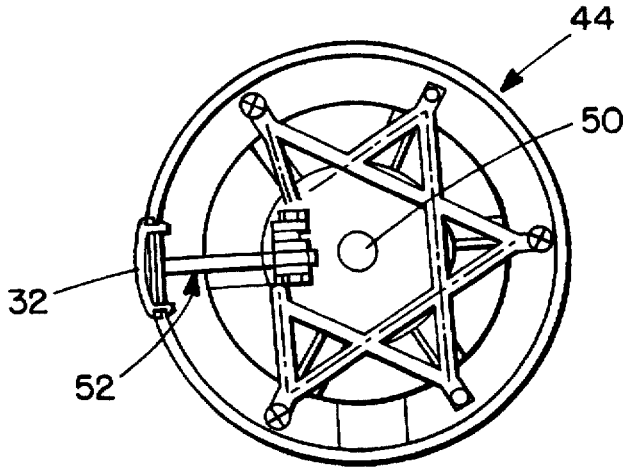
FIG. 6 is a rear sectional view of the hair dryer taken along line 6—6 of FIG. 5.

Referring to FIG. 6, an end view of cord reel 44 is shown after the power cord has been unreeled therefrom. Cord reel 44 includes a retract mechanism 52 that is activated by the user via retract button 32. As described above, retract button 32 may be held by the user to automatically cause a rewinding of power cord 34 about cord reel 44. By contrast, when the power cord is unreeled, a spring (not shown) is set which, upon depression of retract button 32, enables the rewinding of the power cord. Cord reel 44 has numerous openings to permit air flow therethrough, but when power cord 34 is wound about cord reel 44, many of these openings are obstructed.

Referring to FIG. 1 in conjunction with FIG. 4, elongated side vents 30 are positioned downstream in the air flow direction from cord reel 44 and provide secondary air pathways 54 to primary air passage 22 at a location between cord reel 44 and air outlet 18. An important safety feature of the present invention is the ability of side vents 30 to enable the passage of air through heating elements 48, even if power cord 34 has not been unreeled. The provision of secondary air pathways 54 thus enables the positioning of cord reel 44 with its axis of rotation aligned with the principal axis of hair blower 10, thereby producing an evenly balanced unit, while preventing overheating in the event the cord remains reeled.

Another feature is the provision of cord stop 38 on power cord 34 leading from its respective plug 56. Cord stop 38 acts as a flexure protector at the junction between power cord 34 and plug 56 and as a stop when power cord 34 is reeled into housing 12.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A hair dryer having a primary air inlet, an air outlet and a primary air passage therebetween with heating means positioned therein, said hair dryer comprising:

a housing;

a cord reel positioned in said housing and having an axis of rotation generally aligned with said primary air passage, said cord reel thereby positioned across said primary air passage and between the air inlet and the air outlet; and at least one vent formed through said housing, said at least one vent being effective to provide a secondary air pathway to the primary air passage at a location between said cord reel and the air outlet, to prevent overheating of said hair dryer in an event of operation thereof when a cord is reeled on said cord reel.

2. The hair dryer of claim 1, wherein the secondary air passage bypasses a section of the primary air passage located between the air inlet and said cord reel.

3. The hair dryer of claim 1, wherein said housing includes opposed walls, and said at least one vent comprises plural openings on both of said opposed walls.

4. The hair dryer of claim 1, wherein said cord reel includes cord retaining means which enable substantial air passage between said primary air inlet and said air outlet when a cord is unreeled therefrom.

5. The hair dryer of claim 4, further comprising a button mechanism positioned in said housing, which when activated by a user, enables said cord reel to retract and coil said power cord about said cord reel.

6. The hair dryer of claim 1, further comprising a cord opening positioned in said housing for passage of said power cord and having a bell-like shape for low friction, high flexibility passage of said power cord.

* * * * *